United States Patent [19]

Haiduk

[11] Patent Number: 4,964,570

[45] Date of Patent: Oct. 23, 1990

[54] PERFUME DISPENSER

[76] Inventor: William Haiduk, 33 Ledgewood Dr., Smithtown, N.Y. 11788

[21] Appl. No.: 440,692

[22] Filed: Nov. 24, 1989

[51] Int. Cl.[5] ..... A44C 15/00

[52] U.S. Cl. ..... 239/36; 63/DIG. 2; 239/309

[58] Field of Search ..... 239/36, 34, 309; 63/DIG. 2, DIG. 1.1

[56] References Cited

U.S. PATENT DOCUMENTS 2,058,274 10/1936 Vivaudou et al. .
2,079,043 5/1937 Samstag .
2,550,828 5/1951 Lawson, Jr. et al. .
2,593,552 4/1952 Folkman ..... 239/309
3,441,353 4/1969 Claff .
4,023,712 5/1977 Babiak et al. .

*Primary Examiner*—Andres Kashnikow
*Assistant Examiner*—L. Morris
*Attorney, Agent, or Firm*—Leonard Belkin

[57] ABSTRACT

An article of jewelry for dispensing perfume consisting of a pair of hollow tubes one of which is provided with a sealed capsule of perfume and the other tube containing venting openings and a needle to penetrate the capsule when the two tubes are assembled and the needle is pushed far enough to make the penetration. The degree of penetration may be adjusted and vapor generation can be maximized by rotating the tube with the needle with respect to the capsule.

6 Claims, 1 Drawing Sheet

PERFUME DISPENSER

BACKGROUND OF THE INVENTION

This invention relates to a perfume dispenser and more particularly to apparatus for dispensing perfume incorporated into personal jewelry.

A variety of arrangements have been developed which employ personal jewelry as a mechanism for dispensing perfume over a period of time.

U.S. Pat. No. 2,058,274 shows an ear ring carrying perfumed particles whose odor permeates the ring. There is no provision in this arrangement for conveniently recharging the ear ring.

In U.S. Pat. No. 2,079,043 there is shown a perfume holder consisting of a lipstick case, a vanity case, and a ring. The perfume holding material is concealed within a compartment covered by an ornamental piece having openings through which the fragrance may pass. The openings are adjustable to regulate the intensity of the fragrance to be produced.

U.S. Pat. No. 2,550,828 discloses an ear ring with a compartment for containing an absorbent pad to carry the perfume.

U.S. Pat. No. 3,441,353 describes a perfume dispenser in which the perfume is microencapsulated and the capsules are dispensed in a variety of ways including the use of tape material. The capsules are crushed as they are dispensed. The purpose of this arrangement is to prevent loss of the highly volatile perfume through evaporation.

U.S. Pat. No. 4,023,712 discloses a portable spray container which is hung on a chain and worn around the neck. The patentees visualize that their patented device would be employed not only to dispense perfume when desired but also a variety of other spray compositions, such as an insect repellant. The wearer activates the container just like any other pressurized container, since it does not passively release any fragrance.

The devices described above are complex, expensive to make, and in some cases require some intervention on the part of the user, and, as a consequence, the use of jewelry for dispensing fragrances has not been adopted by the general public. People generally continue to rely on the well known and long used methods of applying the perfume directly to the skin or clothing using an atomizer or an applicator. This is still generally done even though the user is fully aware that the fragrance will disappear as the perfume dissipates.

SUMMARY OF THE INVENTION

The present invention overcomes many of the difficulties associated with the use of jewelry to dispense perfume by providing in a necklace a mechanism which is simple and reliable in construction, convenient and easy for the wearer to use, and is readily refillable.

A preferred embodiment of this invention consists of a cylinder made of hollow upper and lower sections. The upper section is provided with a series of holes for permitting the fragrance bearing vapors to pass out and a piercing pin mounted internally. The lower section contains the perfume sealed in a removable throw away capsule. When the lower section comes together with the upper section of the cylinder, the piercing pin penetrates the capsule releasing the fragrance. The dispenser being of suitable ornamental design may be worn around the neck as a necklace, worn as a lapel pin, or a tie clasp.

It is thus a principal object of this invention to provide an improved perfume dispenser which is economic in construction, convenient to use and refill, and suitable for being worn.

DESCRIPTION OF THE PREFERRED EMBODIMENT

Figure 1:
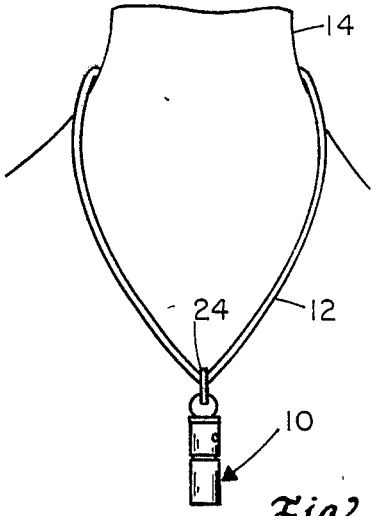
FIG. 1 is an elevation view of a preferred embodiment of this invention in use.

Referring to FIG. 1 there is shown dispenser 10 suspended on a chain 12 and being worn around the neck by user 14 as a necklace or a piece of personal jewelry. It is understood that dispenser 10 may be provided with suitable ornamentation to make it useful for such a person.

Figure 2:
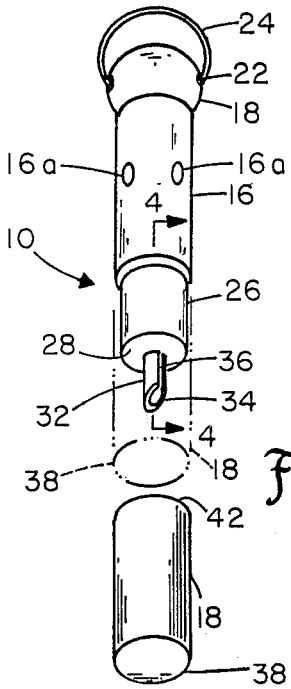
FIG. 2 is an exploded isometric view of the embodiment of FIG. 1 showing the upper and lower parts of the cylinder.

As seen in FIG. 2, dispenser 10 is cylindrical in configuration and consists of a hollow upper part 16 and a hollow lower part 18.

Figure 4:
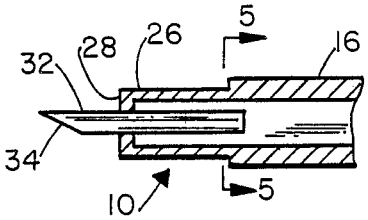
FIG. 4 is a section view taken along 4—4 of FIG. 2.
Figure 5:
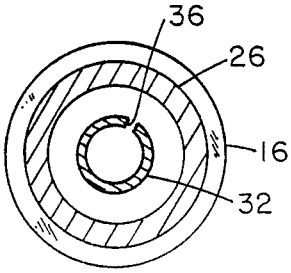
FIG. 5 is a section view taken along 5—5 of FIG. 4.

Upper part 16 is provided with a knob or other suitable holding accessory 18 having an opening 22 to accomodate a ring 24 and a plurality of openings **16*a*. The bottom portion of upper part 16 as also seen in FIGS. 4 and 5 has a reduced diameter section 26 closed by a wall 28 through which passes and is mounted a hollow needle 32 having a sloped tip 34 and an axially extended slot 36** as illustrated.

Lower part 18 is hollow and closed at bottom 38 and open at its upper end 42 to accomodate cylindrical capsule 44.

Cylindrical capsule is a sealed, hollow member containing the perfume or other volatile material and is made out of a suitable penetratable, impermeable material such as plastic or impregnated paper so that the contents are sealed against loss of vapors or fragrance passing through its walls. However, the material should be such as to be capable of being penetrated by needle 32 in the manner to be described.

In the use of dispenser 10, a capsule 44 containing perfume, insecticide, or other volatile material designed to evaporate and produce vapors such as a fragrance, is dropped into lower part 18.

Then upper part 16 is inserted into lower part 18 as shown in phantom in FIG. 2. Needle 32 penetrates the upper surface of capsule 44 thereby permitting the material contained therein to evaporate and the vapors passing into upper part 16 through hollow needle 32 and out of upper part 16 by way of openings **16*a***.

Figure 6:
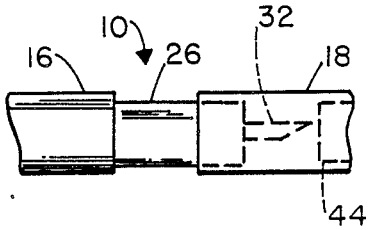
FIG. 6 is a detail showing the parts of the dispenser only partially engaged for use without any fragrance being produced.

The lengths of capsule 44 and needle 32 may be such that when upper part 16 is inserted only part way into lower part 18 the tip of needle 32 will not penetrate capsule 44 as shown in FIG. 6, so that dispenser 10 may be worn without giving off any fragrance. When the wearer decides he or she wants the fragrance to be present, the two parts 16 and 18 may be pushed further together, until needle 32 penetrates capsule 44.

The user also has some control over the rate of delivery of the fragrance or vapors. Needle 32 has a sloped tip as previously described so that the extent of penetration is a function of how deeply needle 32 penetrates capsule 44 and whether the user rotates lower part 18 with respect to upper part 16. By pushing the two parts all the way together as shown in phantom in FIG. 2 and rotating one with respect to the other there is maximum delivery of the vapors because this maximizes the size of the opening into capsule 44. Slot 36 in needle 32 facilitates the transfer of vapors from within capsule 44 into upper part 16 of dispenser 10.

Capsule 44 is removable and disposable so that it is convenient to change the fragrance of the perfume and also to change to an insecticide or insect repellent if required. The inside of lower member 18 may be provided with a key and capsule 44 with a matching key along its outer surface so that capsule 44 will not rotate when the two members are rotated with respect to each other to maximize vapor generation.

Figure 7:
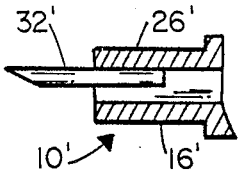
FIG. 7 is a section view similar to FIG. 4 showing an alternative embodiment of this invention.
Figure 3:
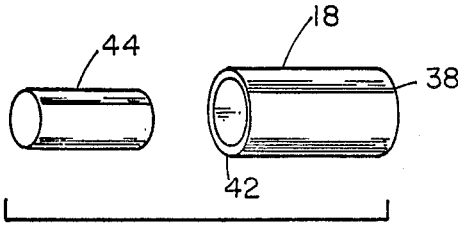
FIG. 3 is an exploded view of the lower part and the capsule.

To increase the ability of dispenser 10 to transfer the vapors from the capsule to the openings in the top part of the dispenser, it may be desirable to provide a full opening in the bottom of the top part of the dispenser. Such an arrangement is shown in FIG. 7 wherein is illustrated dispenser 10' identical to dispenser 10 except for the changes shown in that figure. Reduced diameter section 26' of upper part 16' is open and needle 32' is mounted in any convenient manner on the inner surface within section 26'. In this manner the flow of the vapors is more readily facilitated due to the full opening into section 26'.

The dispenser as described above can be designed to be worn as shown around the neck as part of a necklace, but it also can be configured to be used as a lapel pin or a tie clasp.

While only a certain preferred embodiment of this invention has been described it is understood that many variations are possible without departing from the principles of this invention as defined in the claims which follow.

What is claimed is:

1. An article of personal jewelry for dispensing a fragrant vapor comprising a first hollow member and a second hollow member forming said article when assembled together, said first hollow member comprising means for ventilating the inside of said first hollow member and means for engaging said second hollow member and being capable of adjusting the extent of the engagement with said second member, said second hollow member containing a sealed capsule containing a volatile material and an opening to receive said engaging means, said engaging means comprising hollow needle means to puncture said capsule when said members are engaged beyond a predetermined point so that said first and second hollow members may be engaged with each other without said needle means penetrating said capsule, the extent of the engagement of said members being readily adjustable so that said article of jewelry may be worn without dispensing any vapor from said capsule and then said members may be moved into closer engagement to cause puncture of said capsule by said needle means to dispense said fragrant vapor.

2. The article of personal jewelry of claim 1 wherein said needle means comprises a hollow needle having a point for puncturing said capsule.

3. The article of personal jewelry of claim 2 wherein said needle has a sloped tip so that the opening into said capsule may be increased by increasing the penetration of said needle into said capsule.

4. The article of personal jewelry of claim 3 wherein said needle is slotted to facilitate flow of vapor from said second hollow member to said first hollow member.

5. The article of personal jewelry of claim 4 wherein the bottom of said first hollow member is closed by a wall and said needle penetrates said wall.

6. The article of personal jewelry of claim 3 wherein the bottom of said first hollow member is open and said needle is mounted along an inner wall of said first hollow member.

* * * * *